US005230197A

United States Patent [19]

Hart

[11] Patent Number: 5,230,197

[45] Date of Patent: Jul. 27, 1993

[54] ADJUSTABLE SPACE FRAMES

[76] Inventor: Garry R. Hart, 80 Uxbridge St., The Grange, Queensland, 4051, Australia

[21] Appl. No.: 653,180

[22] Filed: Feb. 11, 1991

Related U.S. Application Data

[63] Continuation-in-part of Ser. No. 318,742, Feb. 23, 1989, abandoned, which is a continuation of Ser. No. 56,485, Apr. 14, 1987, abandoned.

[51] Int. Cl.[5] ..... E04H 12/00

[52] U.S. Cl. ..... 52/653.2; 52/638

[58] Field of Search ..... 52/648, 646, 645, 80, 52/81, 86; 14/13-17, 3-5

[56] References Cited

U.S. PATENT DOCUMENTS

| | | | |
|---|---|---|---|
| 346,466 | 8/1886 | Corbett | 52/638 |
| 642,588 | 2/1900 | Davis | 52/638 |
| 1,846,772 | 2/1932 | Wallis | 52/638 |
| 2,659,618 | 11/1953 | Capra . | |
| 4,630,550 | 12/1986 | Weitzman | 403/171 |
| 4,745,725 | 5/1988 | Onoda | 52/655 |

OTHER PUBLICATIONS

Raumliche Tragwerke aus Stahl Jun. 1963, pp. 139,148 TH/61/m3.

*Primary Examiner*—David A. Scherbel
*Assistant Examiner*—Creighton Smith
*Attorney, Agent, or Firm*—Kimmel, Crowell & Weaver

[57] ABSTRACT

An adjustable space frame has upper and lower grids formed of longitudinal and lateral chords connected to vertical posts at nodal connection points.

Tension braces interconnect the chords in the respective grids. By selective adjustment of the tension in the tension braces, the degree of rigidity in the space frame can be varied and the space frame may be selectively curved or cambered in either the longitudinal and/or lateral directions. When rigid braces are used in the lateral direction, the curvature will be in the longitudinal direction.

The posts may be inclined to provide lateral restrain for the space frame and the grids may be relatively offset.

15 Claims, 7 Drawing Sheets

ADJUSTABLE SPACE FRAMES

This is a continuation-in-part of application Ser. No. 07/318,742, filed Feb. 23, 1989, abandoned, which is a continuation of application Ser. No. 07/056,485, filed Apr. 14, 1987, now abandoned.

BACKGROUND OF THE INVENTION

1. Field of the Invention

This invention relates to adjustable space frames. The invention is also directed to improved methods for connecting and bracing the space frame components.

2. Description of the Prior Art

Space frames are particularly suited to spanning large areas where minimal obstruction by supporting columns is required. Existing space frames generally consist of interconnected members which form nonadjustable triangulated structures which have a number of practical limitations. The frames often require expensive node connectors and the components manufactured to close tolerances. The space frames are generally rigid and unyielding and are difficult to assemble. Curved structures generally require special members and increased construction time. Finally, they are difficult to design as the use of a large number of components connected at nodes make them difficult to computer model because complex computer design analysis techniques must be employed.

SUMMARY OF THE PRESENT INVENTION

It is an object of the present invention to provide adjustable space frames which are easy to assemble and which do not require close tolerances of the components.

It is also an object to provide adjustable space frames which avoid the need for complex node connectors and yet allow for a wide range of geometries, including curved frames.

It is a further object of the present invention to provide adjustable space frames which can be precambered and which can be very ductile to very rigid, depending on the proposed application.

It is a still further object to provide adjustable space frames which can be easily analyzed and assembled in the manner of two dimensioned trusses and which can be easily varied to suit different stresses on the components throughout the frames.

Other objects of the present invention will become apparent from the following description.

In one aspect, the present invention resides in an adjustable space frame including an upper grid of chords intersecting at a plurality of nodes and a lower grid of chords intersecting at a plurality of nodes, wherein at least one of the nodes in the upper grid is connected to at least one of the nodes in the lower grid by a tension and/or compression brace or strut which is adjustable to apply curvature to the space frame and/or to vary the rigidity of the space frame.

Preferably, the nodes of the upper grid are connected to corresponding nodes in the lower grid by posts to which the chords are connected, and a pair of diagonal tension braces interconnect the nodes on an adjacent pair of posts in the frame.

Alternatively, in a rectangular frame, which in plan view appears to comprise a series of interconnected "boxes", the tension braces may extend diagonally across the boxes between the posts at opposite corners of the boxes.

The tension braces may be arranged longitudinally and/or laterally relative to the frame to enable cambering of the frame in one or two directions. Non-adjustable braces may be provided in the direction which does not require cambering or curvature. The frames may be triangular, square, rectangular, hexagonal or any other suitable regular polygon in plan view, and the chords of the lower grid may underlie, or be offset relative to the chords of the upper grid.

A second aspect of the present invention resides in a method for connecting the chords to a node of a space frame including a post at the node; at least one stub extending from the post to engage a respective chord in the space frames; and means to connect the chord to the stub.

A third aspect of the present invention resides in a method for connecting the chords to a node of a space frame including a post at the node; at least one hole or slot in the post to receive a respective chord in the space frame; and means to connect the chord to the hole or slot in the post.

The tension bracing may include a pair of U- or D-shaped brackets, or L-shaped straps, connectable to the chords and/or posts by bolts or other fasteners, interconnected by rods or flexible cables; tensioned rods received in holes in the chords are tensioned by nuts on threaded ends of the rods; or a pair of rods connected by a turnbuckle.

BRIEF DESCRIPTION OF THE DRAWINGS

To enable,.the invention to be fully understood, a number of preferred embodiments will now be described with reference to the accompanying drawings, in which.

Figure 26A:
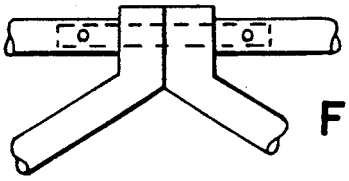
FIG. 26 is a side view of a third type of space frame using inclined posts and adjustable chords.
Figure 26:
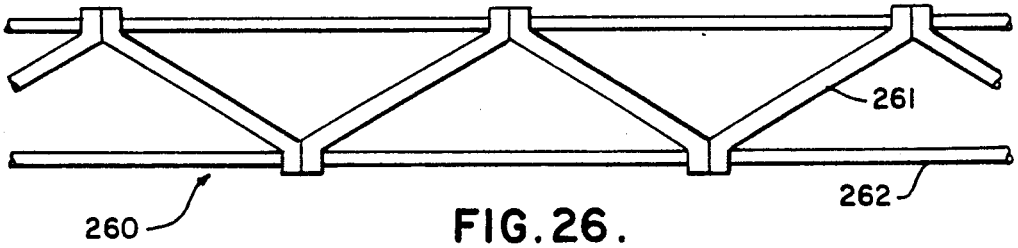

FIG. **26*a* is a detail of a portion of FIG. 26**; and

Figure 27:
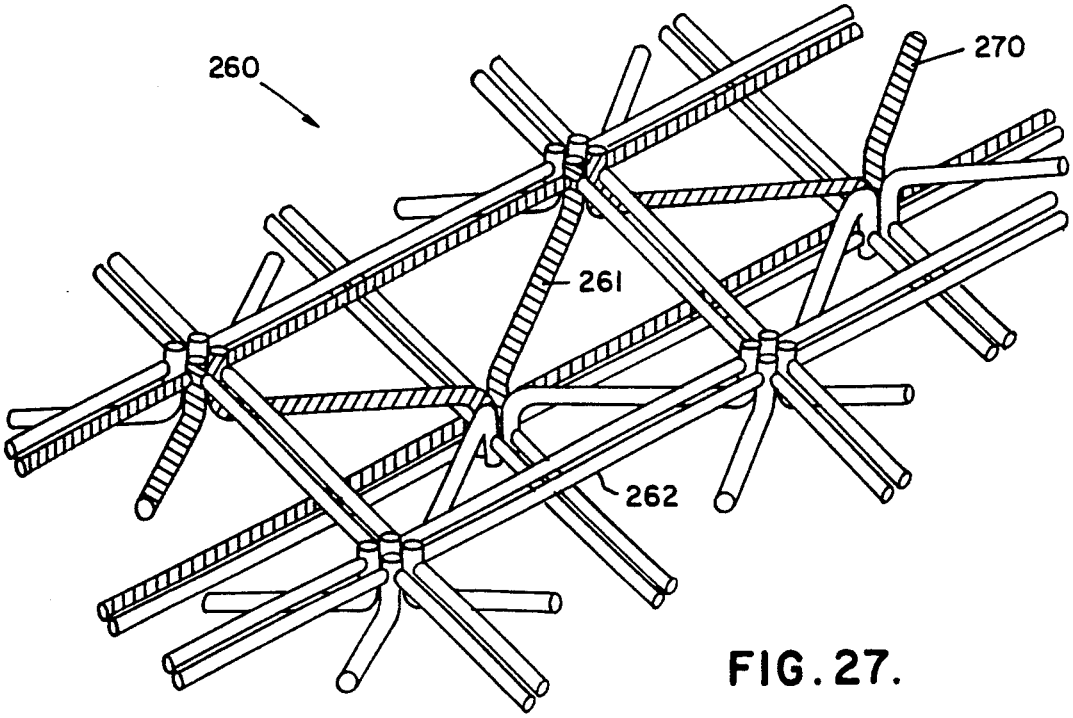

FIG. 27 is an isometric view of the space frame of FIG. 26.

DETAILED DESCRIPTION OF THE PREFERRED EMBODIMENT

Figure 1:
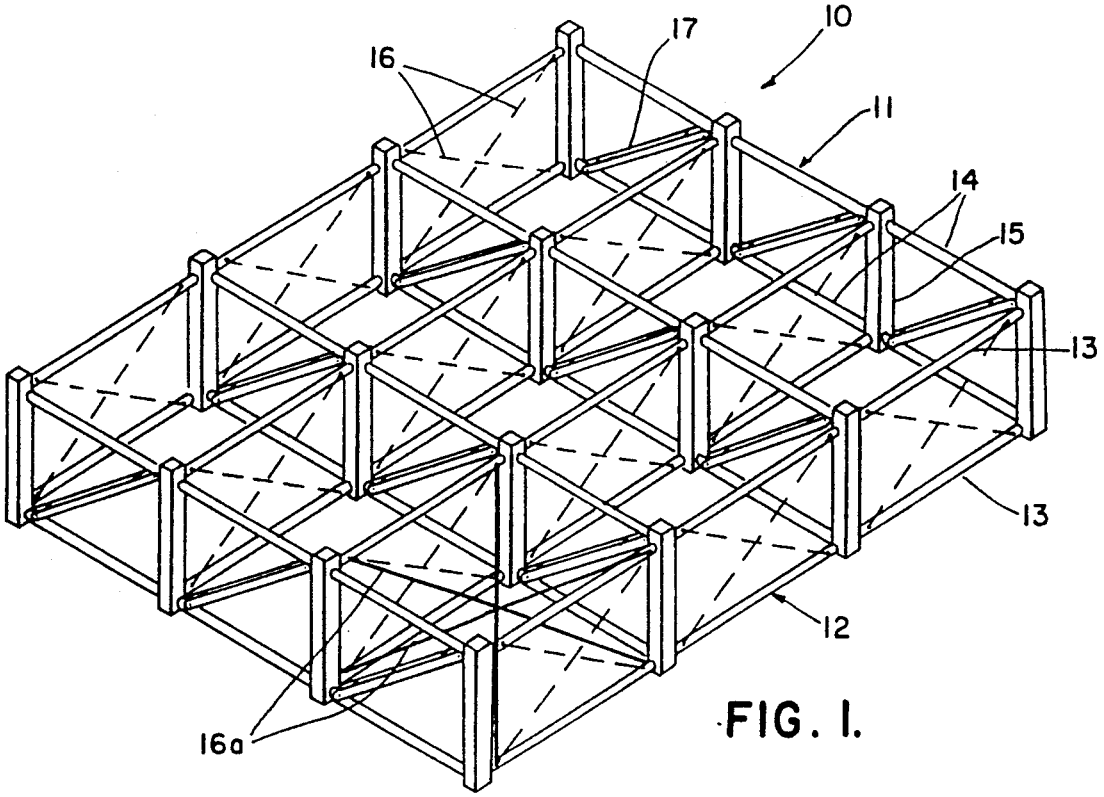
FIG. 1 is an isometric view of a space frame adjustable in one direction.

Referring to FIG. 1, the space frame 10 has respective upper and lower grids 11, 12 with longitudinal and lateral chords 13, 14, each of a fixed length, connected to vertical posts 15 at nodal connection points defining regular rectangular boxes.

Tension braces 16, indicated by dashed lines, interconnect the longitudinal chords 13 of one grid with the aligned longitudinal chords 13 of the other grid, while rigid braces 17 interconnect the lateral chords 14.

The tension braces have infinitely variable lengths. By selective adjustment of the tension braces 16, the frame 10 may be cambered or curved along the longitudinal "trusses".

As an alternative, the tension braces may be provided diagonally across the "boxes" as indicated by the solid lines 16*a* to produce a highly rigid frame. (If the tension braces 16 have a low tension, the frame 10 will be very ductile in the longitudinal direction while being very rigid in the lateral direction due to the rigid braces 17.) By increasing the tension in the tension braces 16, the frame 10 will become more rigid in the longitudinal direction.

Figure 2:
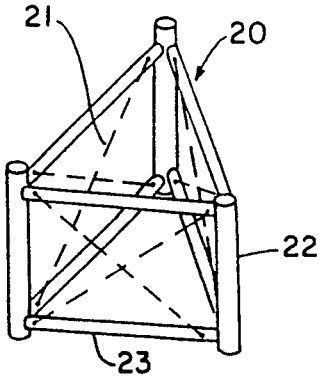
FIGS. 2 to 4 are isometric views of triangular, hexagonal and hexagonal space frames respectively.
Figure 3:
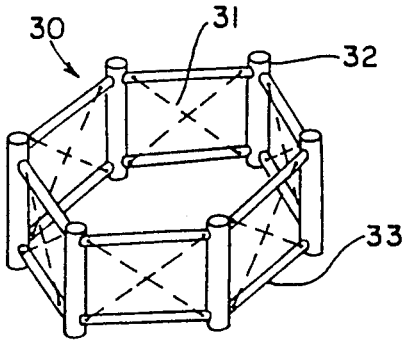
Figure 4:
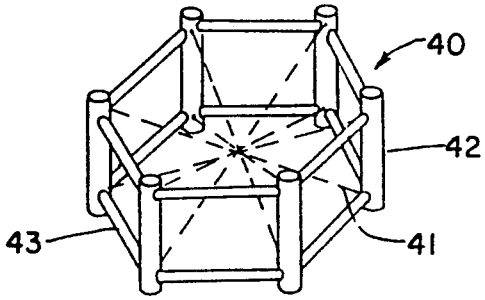

FIGS. 2 and 3 show triangular and hexagonal space frames 20, 30 respectively, where the tension braces 21, 31 lie within vertical planes interconnecting the posts 22, 32, while FIG. 4 shows a hexagonal space frame 40 where the tension braces 41 extend diagonally across the frame to connect diagonally opposed posts 42. In all these frames, the chords 23, 33, 43 in the upper and lower grids are vertically aligned.

Figure 5:
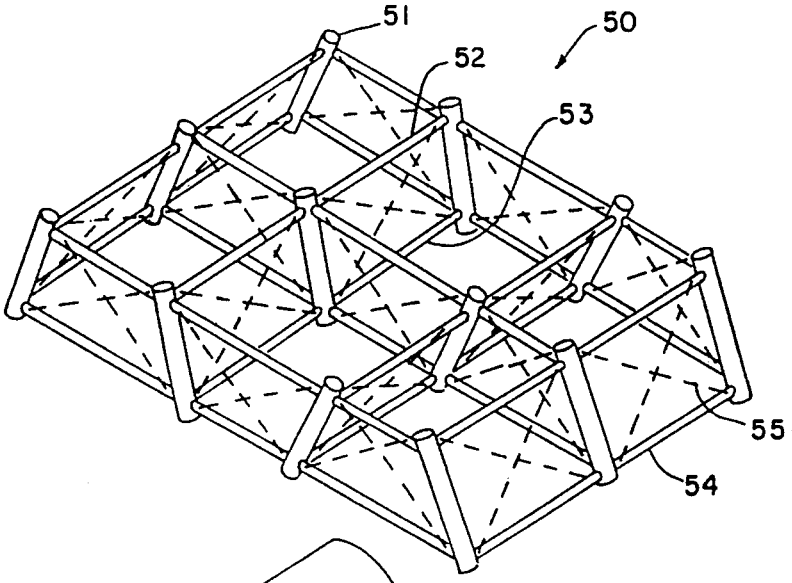
FIG. 5 is an isometric view of a space frame where the lateral chords in the grid are offset.

FIG. 5 shows a space frame 50 where the posts 51 are inclined so that the lateral chords 52 of the upper grid are offset relative to the lateral chords 53 of the lower grid, the longitudinal chords 54 being aligned and the tension braces 55 lie along the longitudinal and lateral axes of the frame. This arrangement provides lateral restraint in the longitudinal directions of the frame.

The methods of connecting the chords to the posts will now be described.

Figure 6:
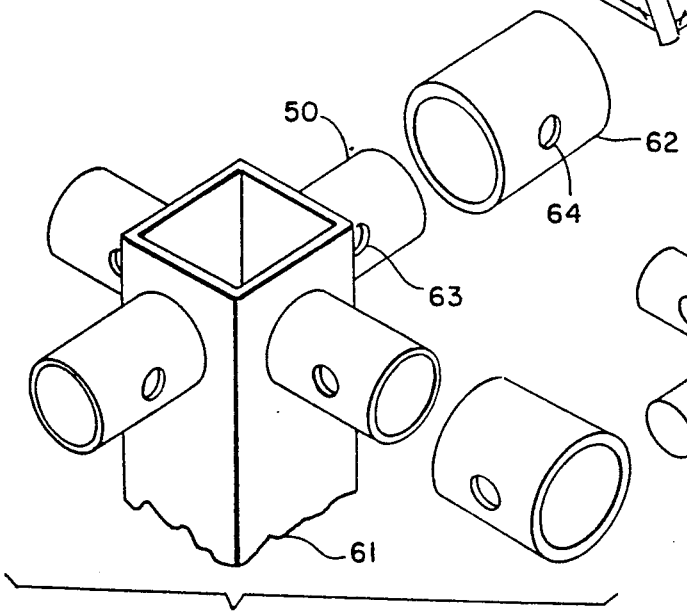
FIGS. 6 to 16 show alternative methods of connecting the chords to the posts.
Figure 7:
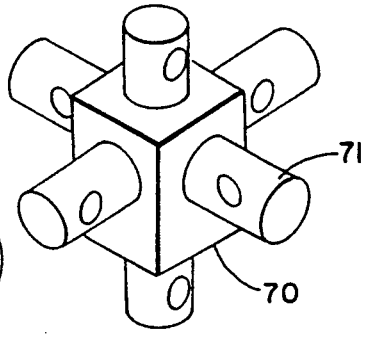

Referring to FIG. 6, tubular stubs 60 are welded to, and extend laterally from the vertical post 61, each stub 60 being arranged to be telescopically received in a respective chord 62, with aligned holes 63, 64 being provided to receive suitable fasteners (not shown) to transfer the load from the chord to the stub in shear. The outside diameter of each stub 60 is substantially less than the inside diameter of each chord 62, resulting in a loose fit that permits the chord to pivot over a limited arc about the fastener axis. In FIG. 7, a block 70 is provided with the stubs 71.

Figure 8:
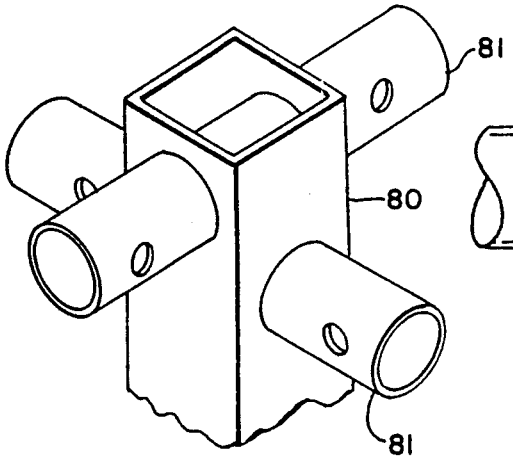
Figure 9:
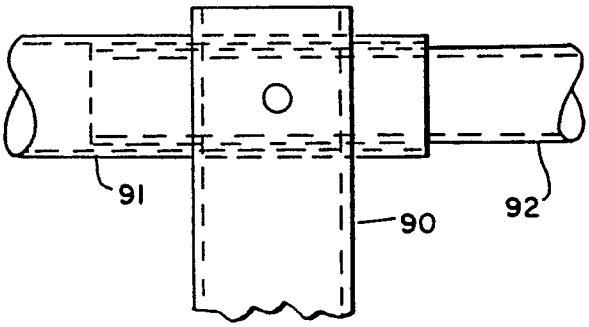
Figure 10:
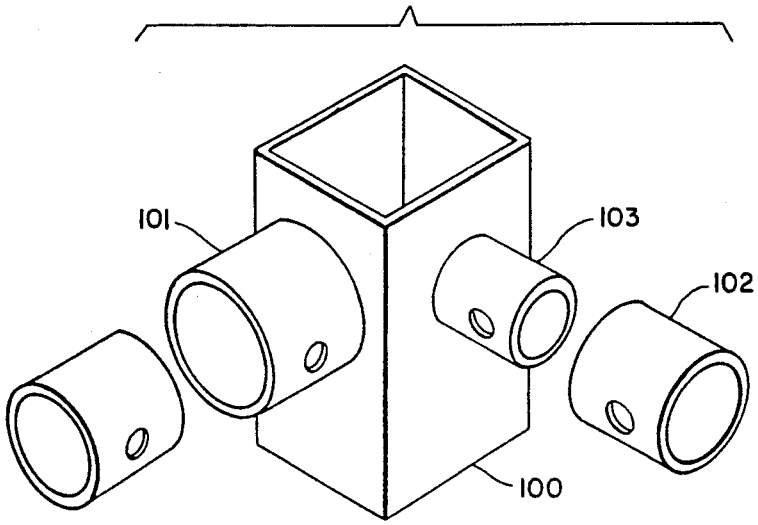
Figure 11:
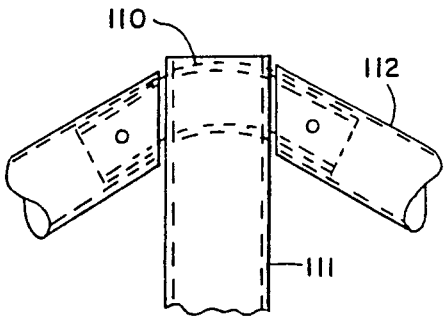

FIG. 8 shows a post 80 where the stubs 81 are formed by a pair of tubes 82 extending through the post, while FIG. 9 shows a post 90 where a chord 91 extends through the post and receives and supports a chord 92 of reduced diameter. This arrangement is particularly suitable where different forces occur in the space frame. Alternatively, as in FIG. 10, each of the posts 100 has a pair of sleeves 101 to receive chords 102 in one direction and a pair of stubs 103 to be inserted in the chords 102 in the other direction.

The stubs 110 (or sleeves) may be inclined to the posts 111 to receive the chords 112 at any suitable angle.

Figure 12:
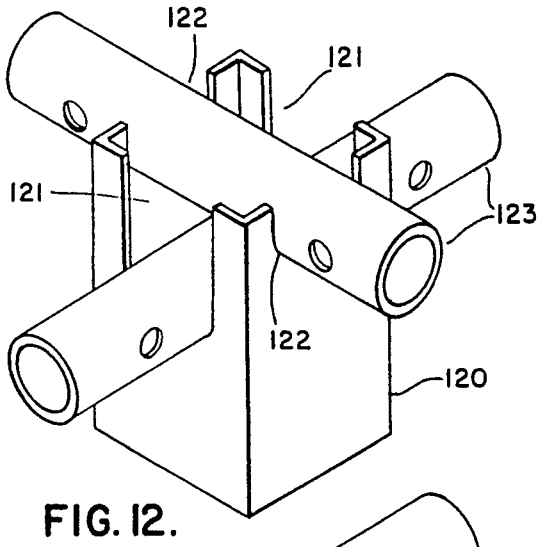

The post 120 in FIG. 12 has aligned pairs of slots 121, 122 to receive sleeve connectors 123 (or continuous chords) in an overlapping arrangement.

Figure 13:
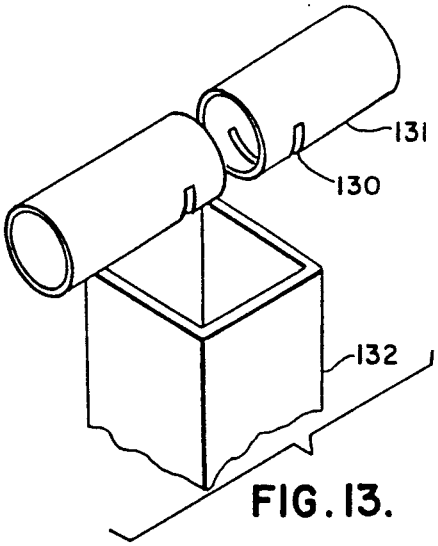
Figure 14:
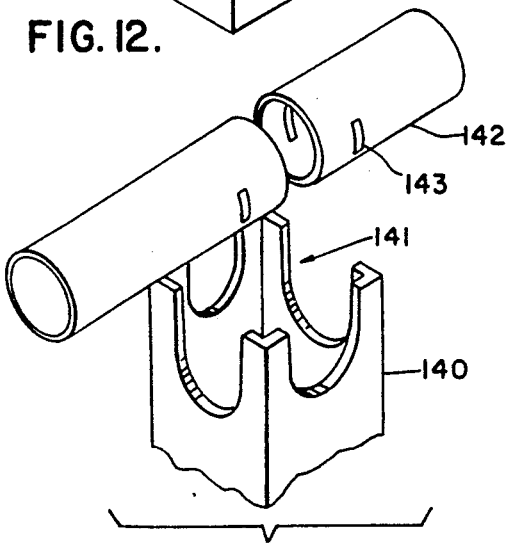

Alternatively, (see FIG. 13) slots 130 may be provided adjacent the ends of the chords 131 to engage the side walls of the posts 132. In FIG. 14, the post 140 has slots 141 which receive the chords 142, which are locked by the engagement of the side walls of the slots 141 in slots 143 formed in the chords.

Figure 15:
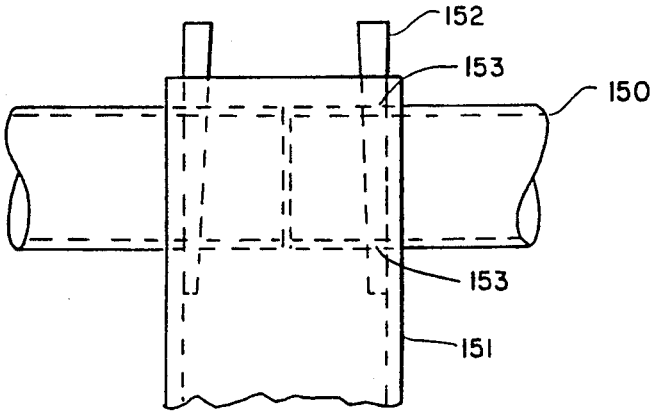

FIG. 15 shows the chords 150 received in holes in the posts 151 and locked by wedges 152 engaged in slots 153 in the chords.

Figure 16:
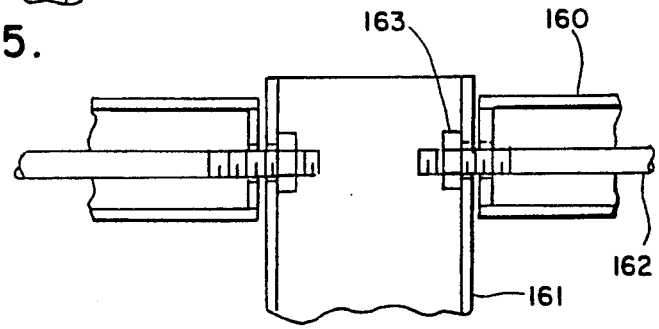

In FIG. 16, the ends of the chords 160 abut the side walls of the post 161 and are secured thereto by threaded tension rods 162 which extend through the chords and are tensioned by nuts 163.

The embodiments described and illustrated are not exhaustive of the methods available to connect the chords to the posts in the space frames of FIGS. 1 to 5.

Figure 17:
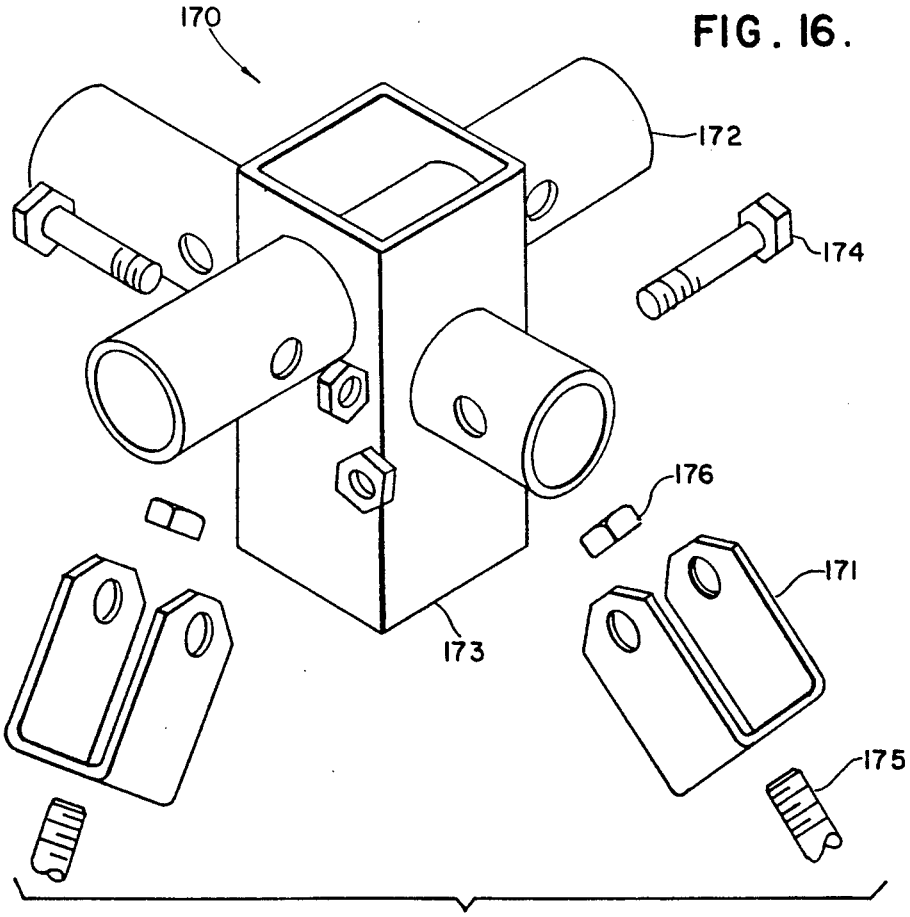
FIGS. 17 tc 21 show alternative types of tension braces.

Referring now to FIG. 17, a tension brace 170 has a U-shaped bracket 171 at each end, each bracket being connected to a respective stub 172 (or sleeve) and chord (not shown) adjacent the post 173 by a bolt fastener 174. The brackets of each brace 170 are connected by a tension rod 175 fitted with tensioning nuts 176. (As an alternative, short thread lengths of tension rod 175 can be provided at each end of a tension cable—not shown.)

Figure 18:
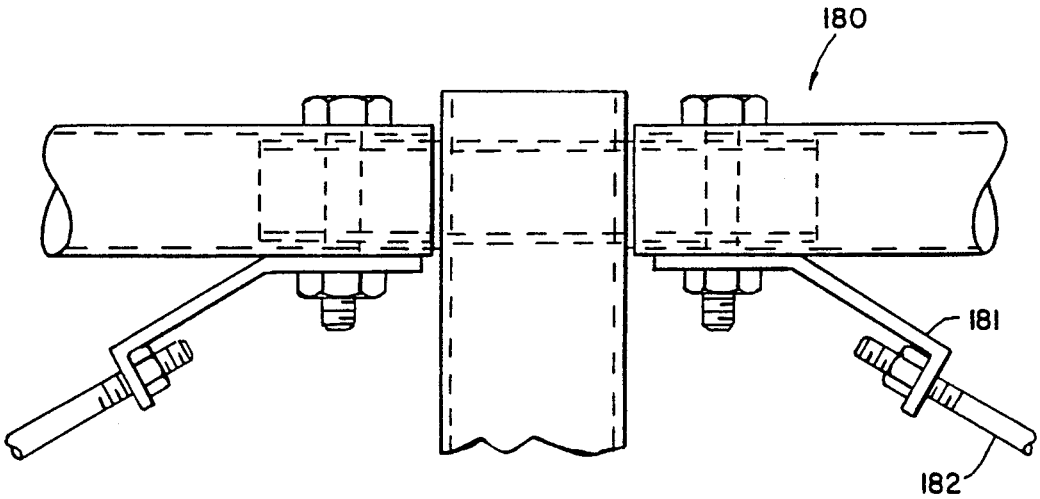
Figure 19:
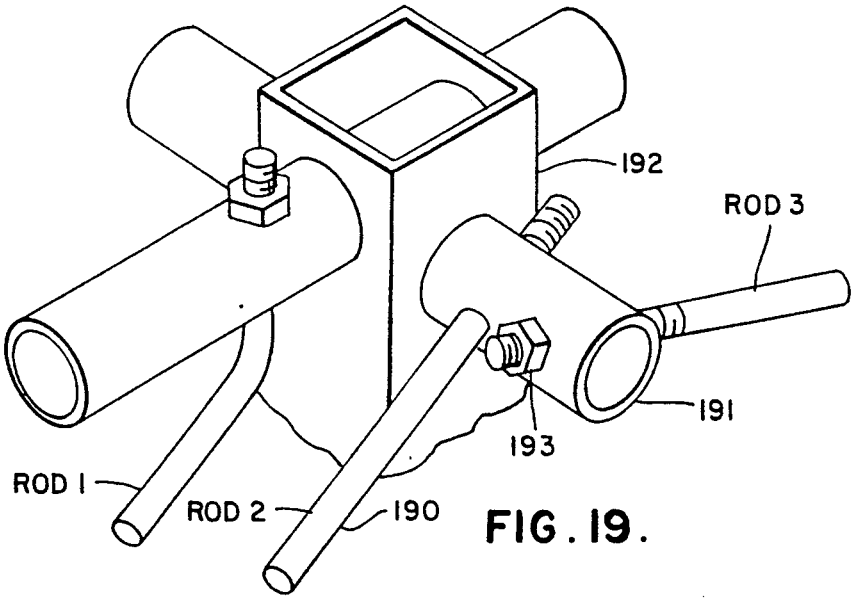

In FIG. 18, the tension brace 180 has substantially L-shaped brackets 181 which receive the ends of the tension rod 182, while in FIG. 19, the ends of the tension rods 190, forming the tension braces, are bent to enable connection directly to the stubs 191 (or chords) on the post 192, the tensioning being effected by the nuts 193.

Figure 20:
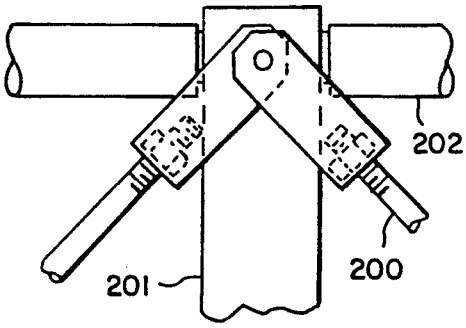
Figure 20A:
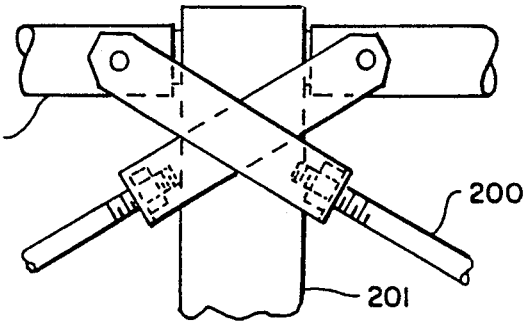

As shown in FIGS. 20 and 20*a*, the tension braces 200 may also be connected to the posts 201 or be overlapped for connection to the stubs and chords 202 on the opposite sides of the posts.

Figure 21:
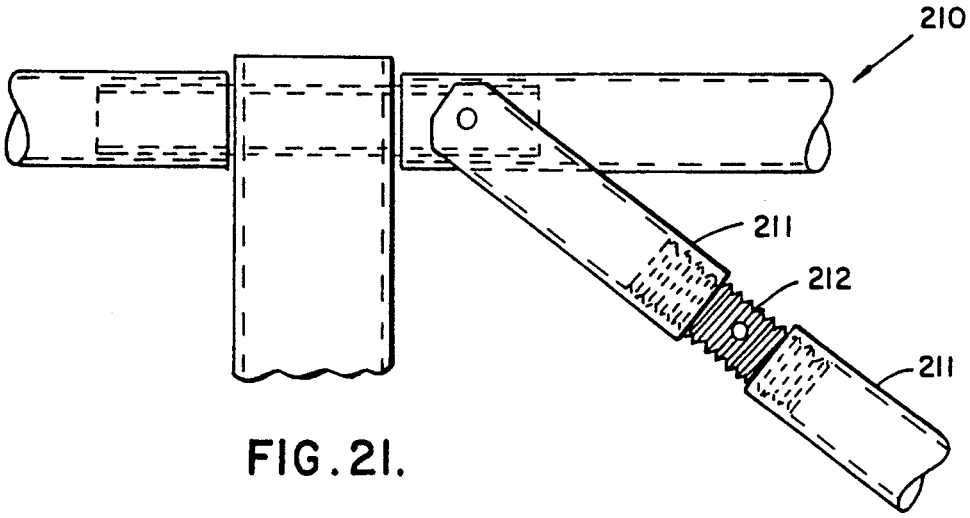

FIG. 21 shows a tension brace 210 which comprises a pair of hollow tension tubes 211 internally threaded to receive a connecting rod 212 in the manner of a turnbuckle to provide the necessary tension.

Figure 22:
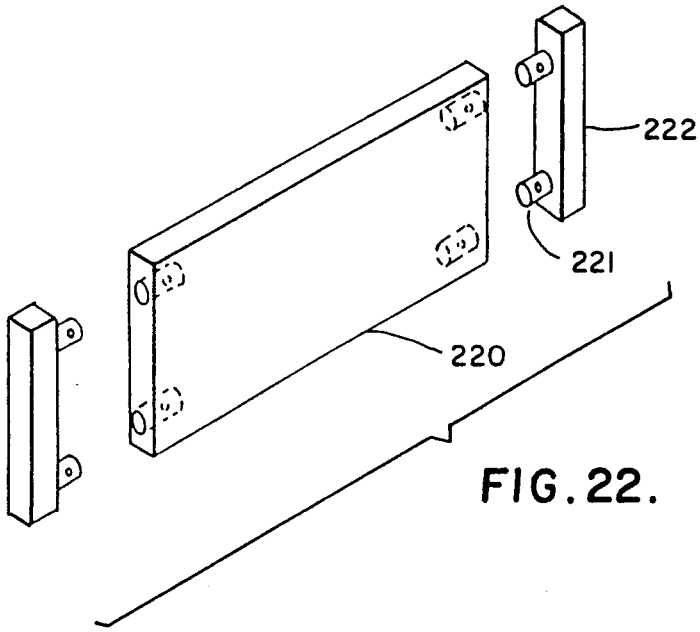
FIG. 22 is a rigid panel which can be used in substitution for the rigid, non-adjustable brace.

In FIG. 1, rigid braces 17 were provided in the lateral direction of the frame. These may be replaced by rigid infill panels 220 (see FIG. 22) which may engage stubs 221 on the posts 222.

Figure 23:
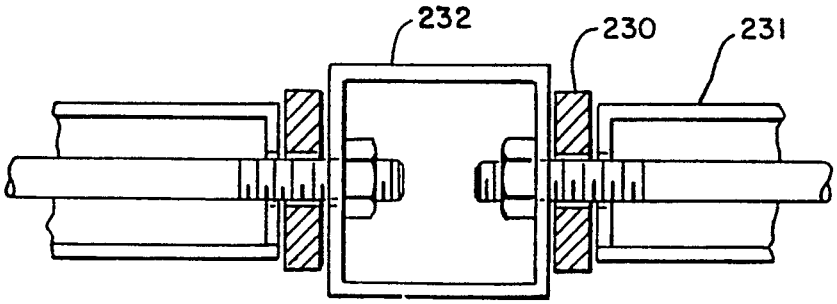
FIG. 23 shows a method for relieving stress in a strut or brace.

FIG. 23 shows a modification of the nodal connection of FIG. 16 where washers 230 of neoprene (or other suitable elastomeric material) are interposed between the ends of the chords 231 and the post 232 to accommodate differences in tolerances in the chords.

In all the preceding embodiments, the posts interconnect the upper and lower grids in the space frames.

Figure 24:
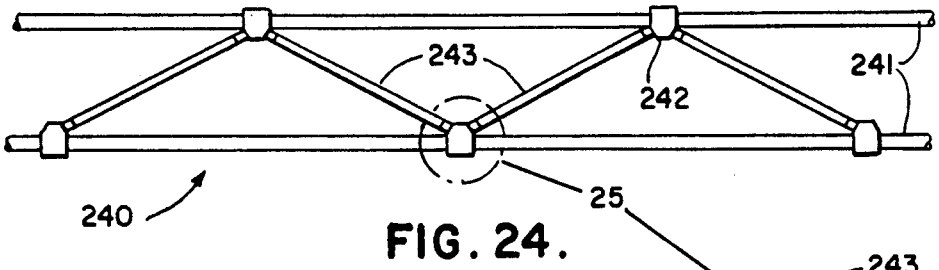
FIG. 24 is a side view of a second type of space frame having blocks at the nodes in substitution for posts.
Figure 25:
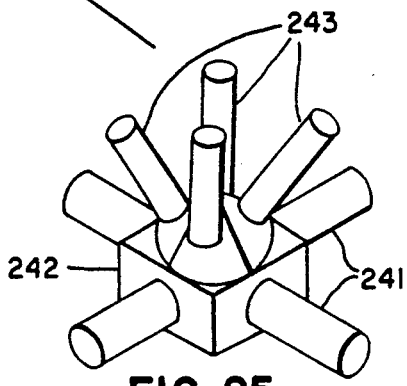
FIG. 25 is an underside isometric view of one of the blocks.

In the space frame 240 in FIG. 24, the chords 241 are of the type shown in FIGS. 16 or 23 and are connected to node blocks 242, the blocks 242 in the grid being connected to compression/tension brackets 243 formed in the manner of the chords 231 in FIG. 23, and being provided with the washers 230 and with tension rods extending through the braces. As the longitudinal and lateral chords of the upper grid are offset relative to the chords of the lower grid, a multi-way triangulation is generated in the frame 240.

The space frame 260 shown in FIGS. 26 and 27 has fixed length posts 261 which are interconnected to adjustable length chords 262 at the nodes, the ends of the post being angled in two directions to allow for the inclination of the posts 261 and of the truss 270 indicated by shading in FIG. 27. The chords 212 may comprise a pair of tubular lengths interconnected by a threaded rod in the manner of the tension braces 210 in FIG. 21.

In all the space frames, the chords may be sealed to the stub/sleeves or posts and water circulated therethrough to give the frames a good fire rating.

During assembly the chords and braces are connected to the posts and the assembly may be effected at ground level before hoisting to the desired height. The tension braces may be tensioned on the ground or after raising the frame and may be tensioned to produce a camber in the frames to oppose any loads e.g. due to the weight of roof panels applied to the frames.

The potential applications for the space frame of the present invention are almost infinite, aided by the ability to curve the frames in one or two directions as desired.

The advantages of the space frames, even existing space frames, will be readily apparent to the skilled addressee, who will also appreciate that the present invention is not limited to the embodiments disclosed by way of illustrative examples only.

I claim:

1. An inexpensive space frame which can be deployed and repackaged and which can be adjusted for curvature and rigidity after being assembled and erected, comprising an upper grid of fixed length chords intersecting at a first plurality of nodes having projecting stubs loosely telescopically engaged with adjacent ends of said chords, and a lower grid of chords intersecting at a second plurality of nodes having projecting stubs for loose fitting telescopic engagement with adjacent ends of said chords, the nodes of the upper grid being connected to the nodes of the lower grid by posts of fixed length and to which the chords are connected;

said chords being connected to said stubs by pinned connections including transverse openings in the stubs and chords, with pins extending through the openings, whereby the chords can pivot about said pins in the plane of said posts; and at least one of the nodes in the upper grid being connected to at least one of the nodes in the lower grid by a tension brace that is continuously adjustable in length and has pinned connections at its ends permitting pivoting movement of the end of the brace or strut relative to the associated node and in the plane of said posts, whereby adjustment in length of the tension brace will apply a curvature to the space frame, the pinned connections and loose fit between the chords and stubs and between the braces and nodes enabling angular adjustment of the frame after assembly thereof without bending or deforming the frame components.

2. A space frame as claimed in claim 1, wherein a pair of diagonal tension braces continuously adjustable in length interconnect the chords on an adjacent pair of posts in the frame.

3. A space frame as claimed in claim 1, wherein a pair of diagonal tension braces continuously adjustable in length interconnect the nodes on an adjacent pair of posts in the frame.

4. A space frame as claimed in claim 1, wherein a pair of diagonal tension braces continuously adjustable in length interconnect the chords of a diagonally opposed pair of posts in the frame.

5. A space frame as claimed in claim 1, wherein a pair of diagonal tension braces continuously adjustable in length interconnect the nodes of a diagonally opposed pair of posts in the frame.

6. A space frame as claimed in claim 1, wherein the chords include longitudinal and lateral chords, and at least one of the longitudinal and lateral chords of one of the grids are offset relative to the corresponding chords of the other grid and the posts are inclined to the vertical.

7. A space frame as claimed in claim 1, wherein the tension braces include one of a U- and L-shaped bracket attachable to one of the chords and posts, the brackets being interconnected by tension rods or cables that are continuously adjustable in length, wherein the bracket acts as a fixing means for each end of the tension brace.

8. A space frame as claimed in claim 1, wherein the tension braces include tension rods received in holes in the U- or L-shaped brackets and have nuts threaded on the ends of the rods to allow continuously adjustable length adjustment of the rods, thus applying a tension to the rods.

9. A space frame as claimed in claim 1, wherein the chords are telescopically engaged with sleeves inserted through the post, and are connected thereto by fasteners which apply the loads between the chords and the sleeves by shear forces in the fasteners.

10. A space frame as claimed in claim 1, wherein the grids are interconnected by rigid braces or infill panels in one direction, with tension braces interconnecting the grids in a second direction.

11. An inexpensive space frame which can be deployed and repackaged and which can be adjusted for curvature and rigidity after being assembled and erected, comprising an upper grid of fixed length chords intersecting at a plurality of nodes having projecting stub means loosely engaged with adjacent ends of said chords, and a lower grid of fixed length chords intersecting at a plurality of nodes having projecting stub means for telescopic engagement with adjacent ends of said chords, the nodes of the upper grid being connected to the nodes of the lower grid by posts of fixed length and to which the chords are connected;

said chords being connected to said stub means by pinned connections including transverse openings in the stub means and chords, with pin means extended through the openings the pinned connections and loose fit enabling the chords to pivot about said pins in the plane of the posts; and at least one of the nodes in the upper grid being connected to at least one of the nodes in the lower grid by a tension brace that is continuously adjustable in length and having pinned connections at its ends permitting pivoting movement of the end of the brace relative to the associated node and in the plane of the posts, where the adjustment in length of the tension brace will adjust the rigidity of the space frame, the pinned connections and loose fit between the chords and stub means and between the brace and nodes enabling angular adjustment of the frame after assembly thereof without introducing bending moments or deformation in the frame components.

12. A space frame as claimed in claim 11, wherein adjustment of the length of the tension brace or braces introduces a beneficial prestressing force into any or all of the posts, chords and tension braces.

13. A space frame as claimed in claim 11, wherein the chords are telescopically engaged with sleeves inserted through the post, wherein the sleeves act as stubs and the chords are connected thereto by pins which apply the loads between the chords and the sleeves by shear forces in the pins.

14. An inexpensive space frame which can be deployed and repackaged and which can be adjusted for curvature and rigidity after being assembled and erected, comprising an upper grid of fixed length chords intersecting at a plurality of nodes having projecting stub means loosely engaged with adjacent ends of said chords, and a lower grid of chords intersecting at a plurality of nodes having projecting stub means for loose fitting pivotal engagement with adjacent ends of said chords, the nodes of the upper grid being connected to the nodes of the lower grid by posts of fixed length and to which the chords are connected;

said chords being connected to said stub means by pinned connections including transverse openings in the stub means and chords, with pin means extended through the openings, whereby the chords are rotatable about said pin means in the plane of said posts; and at least one of the nodes in the upper grid being connected to at least one of the nodes in the lower grid by the combination of at least one fixed length strut and at least one tension brace that is continuously adjustable in length, and having pinned connections at the ends permitting pivoting movement of the end of the brace or strut relative to the associated node and in the plane of said post, where the adjustment in length of the tension brace will apply a curvature to the space frame, the pinned connections and loose fit between the chords and stub means and between the brace or strut and nodes enabling angular adjustment of the frame after assembly thereof without introducing bending moments or deformation in the frame components.

15. An inexpensive space frame which can be deployed and repackaged and which can be adjusted for curvature and rigidity after being assembled and erected, comprising an upper grid of fixed length chords intersecting at a plurality of nodes having projecting stub means loosely engaged with adjacent ends of sid chords, and a lower grid of fixed length chords intersecting at a plurality of nodes having projecting stub means for telescopic engagement with adjacent ends of said chords, the nodes of the upper grid being connected to the nodes of the lower grid by posts of fixed length and to which the chords are connected;

said chords being connected to said stub means by pinned connections including transverse openings in the stub means and chords, with pin means extended through the openings, the pinned connections and loose fit enabling the chords to pivot about said pins in the plane of the posts; and at least one of the nodes in the upper grid being connected to at least one of the nodes in the lower grid by the combination of at least one fixed length strut and at least one tension brace that is continuously adjustable in length, and having pinned connections at the ends permitting pivoting movement of the end of the brace or strut relative to the associated node and in the plane of the posts, where the adjustment in length of the tension brace will adjust the rigidity of the space frame, the pinned connections and loose fit between the chords and stub means and between the brace or strut and nodes enabling angular adjustment of the frame after assembly thereof without introducing bending moments or deformation in the frame components.

* * * * *